United States Patent [19]

Thibault

[11] 4,072,025

[45] Feb. 7, 1978

[54] REGENERATION-TYPE CRYOPUMP

[75] Inventor: Jean-Jacques Thibault, Saint Martin d'Uriage, France

[73] Assignee: L'Air Liquide, Societe Anonyme pour l'Etude et l'Exploitation des Procedes Georges Claude, Paris, France

[21] Appl. No.: 712,916

[22] Filed: Aug. 9, 1976

[30] Foreign Application Priority Data

Aug. 22, 1975 France ..... 75 25970

[51] Int. Cl.[2] ..... B01D 5/00

[52] U.S. Cl. ..... 62/55.5; 62/268; 417/901; 55/DIG. 15

[58] Field of Search ..... 62/55.5, 100, 268; 55/DIG. 15; 417/901

[56] References Cited

U.S. PATENT DOCUMENTS

| | | | |
|---|---|---|---|
| 3,019,809 | 2/1962 | Ipsen et al. | 62/55.5 |
| 3,168,819 | 2/1965 | Santeler | 62/268 |
| 3,668,881 | 6/1972 | Thibault et al. | 62/55.5 |
| 3,797,264 | 3/1974 | Thibault et al. | 62/55.5 |

FOREIGN PATENT DOCUMENTS

| | | | |
|---|---|---|---|
| 751,878 | 7/1956 | United Kingdom | 55/DIG. 15 |
| 1,201,008 | 8/1970 | United Kingdom | 62/55.5 |

*Primary Examiner*—Ronald C. Capossela
*Attorney, Agent, or Firm*—Young & Thompson

[57] ABSTRACT

The invention relates to a regeneration-type cryopump which has an annular reservoir for liquid nitrogen situated above an annular reservoir for liquid helium and incorporates, sliding in the central opening in the said reservoir, a valve member which is mounted on a rod. When the valve member is in one position, the cryopump is in normal operation, whereas when the valve member is in another position and rests against a seating, regeneration may take place.

Such a pump may be used for generating very high vacua.

3 Claims, 5 Drawing Figures

REGENERATION-TYPE CRYOPUMP

BACKGROUND OF THE INVENTION

The present invention relates to a regeneration-type cryopump of the kind comprising a housing containing a pumping duct having a flange for connecting it to an enclosure to be evacuated, and condensing, sublimating and, where applicable, adsorption/desorption means for trapping gases cryogenically. Such cryopumps are used in association with a valve which is inserted between the flange of the pumping duct and the enclosure to be evacuated. The purpose of the valve is to permit total isolation in particular when the cryopump is being regenerated, this operation consisting, as is known, of heating the trapping means of the cryopump to enable the gases which have been trapped as condensed or adsorbed deposits to be withdrawn by an auxiliary pump after having been restored to the gaseous state.

It is known that valves which are sealed against high vacua are particularly complex and expensive, in particular because they have to be so produced as to be capable of being over-heated to a temperature of approximately 500° C, which rules out the use of conventional sealing glands. In certain designs of cryopump for ultra-high vacua, it is important for the pumping duct to be of particularly large dimensions, e.g. as much as 500 millimeters or even more, in order to ensure that the gases coming from the enclosure to be pumped out have maximum access to the trapping means. The latter can thus be in the form of annular structure coaxial with the said pumping duct, this annular trapping structure having a wide central opening so as to be accessible to the gases for the whole of its extent. It will be appreciated that in particularly high performance designs of this kind the valve is a component of major importance, not only because of the isolating function which it performs but also because of its considerable size. Also, in view of this size, the presence of a valve between the cryopump and an enclosure to be evacuated results in a pressure loss which, even though small, results in a reduction in pumping efficiency.

It is an object of the present invention to provide a regeneration-type cryopump which incorporates within it the parts required to form a pseudo-valve in conjunction with the pumping duct, thus making it unnecessary to insert a valve body between the cryopump proper and the enclosure to be pumped out and enabling a direct connection to be made to the enclosure to be evacuated, at the same time as the trapping means remain perfectly accessible.

Another object of the invention is to provide such a cryopump which incorporates a pseudo-valve which can be over-heated to a temperature of 500° C and yet which still provides a sufficiently good seal to allow the cryopump to be regenerated without having a serious effect on the level of vacuum reached in the enclosure to be evacuated.

A further object of the invention is to provide a cryopump of this kind which is impeccably sealed by simple means and yet which can be over-heated to a moderately high temperature such as one of the order of 150° C.

Another object of the invention is to provide a cryopump of the kind having a pseudo-valve, which can be connected to the enclosure to be evacuated either by its top or its bottom.

SUMMARY OF THE INVENTION

The invention consists in a regeneration-type pump of the kind described above, which is chiefly characterised in that it has, in operation, a single duct leading to the exterior and in that the axial sliding travel of the valve member extends from a closed position, in which the said valve member co-operates with a valve seating mounted on the said single duct, to an open position in which it is withdrawn axially towards one end wall of the housing, in which position there is direct access to the whole of the annular trapping structure from the said pumping duct. By virtue of this arrangement not only is the most convenient access provided, as before, for the gas extracted from the enclosure to be evacuated to the annular trapping structure, but advantage is also taken of the central opening in the annular trapping structure to fit in it an axially movable valve member which, by co-operating with a valve seating suitably attached to the pumping duct, allows the cryopump to be isolated from the enclosure to be pumped out, during regeneration phases for example, and which, during pumping, is withdrawn axially in such a way that there is still the same excellent access to the trapping structure.

BRIEF DESCRIPTION OF THE DRAWINGS

These features will become apparent from a perusal of the following description, taken in conjunction with the accompanying drawings in which.

DETAILED DESCRIPTION OF PREFERRED EMBODIMENTS

Figure 1:
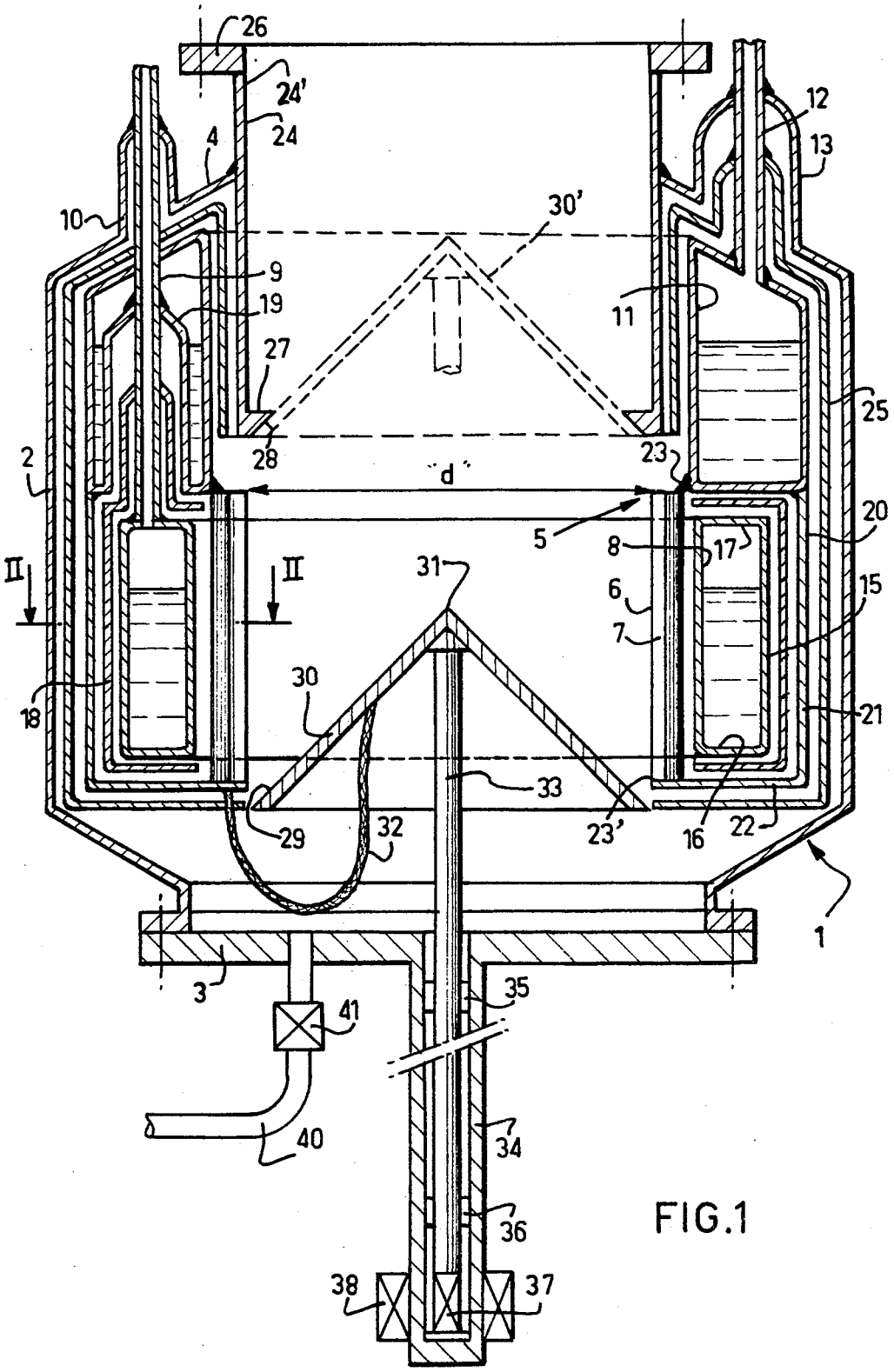
FIG. 1 is an axial section through one particular embodiment of cryopump according to the invention.
Figure 2:
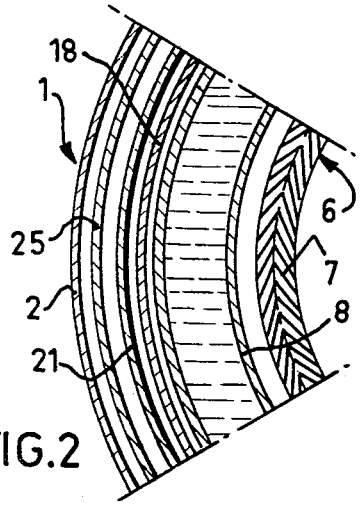
FIG. 2 is a cross-section on line II—II of FIG. 1, FIGS. 3 and 4 are schematic views of a modified embodiment of pump having two opposing pumping ducts only one of which may be used.

Referring now to the drawings, FIGS. 1 and 2, show a regeneration-type cryopump which has a housing 1 of broadly cylindrical shape with a side wall 2, a lower end-wall 3 and an upper end-wall 4, and trapping means 5 which are formed in essence by an annular baffle wall 6 of the type which has chevron-shaped vanes 7 on the inside. A short distance away from the vanes 7 is situated an annular reservoir 8 for liquid helium which is attached by a filling spout 9 to an attachment dome 10 on the upper end-wall 4. Above the liquid helium reservoir 8 is situated an annular reservoir 11 for liquid nitrogen which once again is attached by a filling spout 12 to an outer dome 13 formed in the upper end-wall 4. In the conventional fashion, the liquid helium reservoir 8 is surrounded on its outer side 15 and at its lower 16 and upper 17 ends by a copper heat shield 18 which is fixed in position on a filling tube 9 inside a blind well 19 which extends into the liquid nitrogen reservoir 11. Where it is fixed the heat shield 18 extends half way into the well 19, so that it is cooled by the helium vapour which is released through the filling tube 9. The liquid nitrogen reservoir 11 is associated with a conductive shielding wall 20 which extends at 21 around the outer peripheral face of the annular liquid helium reservoir 8 at a distance from it and at 22 around the annular end-wall 16 of this same reservoir 8, likewise at a distance from it. The annular baffle wall 6 is welded along its upper edge at 23 to the lower inside edge of the liquid nitrogen reservoir 11 and along its lower edge at 23' to the end of the re-entrant part 22 of wall 20.

As can be seen from the drawings, the annular structure of the trapping means 5 leaves an axial opening whose diameter "*d*" is substantially the same as the diameter of a pumping duct 24 which passes through the upper wall 4 and which extends substantially within the housing 1 to be surrounded at a distance by the liquid nitrogen reservoir 11 for a substantial proportion of its axial length.

The liquid nitrogen reservoir 11 and the wall 20 which is thermally associated with it also have arranged entirely around them at a distance a heat shield 25 which also extends into the gap between the liquid nitrogen reservoir 11 and the pumping duct 24.

At its outer end 24' the pumping duct 24 has a flange 26 to connect it to an enclosure to be evacuated which is not shown. At the end situated inside the housing 4, the pumping duct 24 carries a metal valve seating 27 of annular shape which has a tapering working face 28 which is adapted to co-operate with a peripheral portion 29 of a valve member 30. The valve member 30 is in the form of a cone whose apex 31 points into the pumping duct 24. This valve member 30 is preferably connected by a braid 32 of a heat-conducting material to the wall 22 which is at the temperature of liquid nitrogen. The valve member 30 is secured to a valve rod 33 which is mounted to slide in a well 34 which extends outwardly from the lower end wall 3. This valve rod 34 is mounted in bearings 35 and 36 and at its free end it has a magnetic portion 37 which is capable of co-operating with an annular magnetised actuating member 38 which is adapted to slide along the outside of well 34.

The way in which the cryopump which has just been described operates is as follows: once the cryopump has been directly connected by means of its flange 26 to an enclosure to be pumped out (not shown), cryogenic liquid is successively introduced into the liquid nitrogen reservoir 11 and then into the liquid helium reservoir 8 until the pump has been lowered to its cold temperature. During the whole of this operation the valve is in the closed position, that is to say the position shown in broken lines at 30'. A certain level of seal exists between valve member 30 and face 28 of valve seating 27. Once the cryopump has been brought down to its low temperature, valve member 30 is moved to the open position by sliding the magnetic ring 38 downwards so that it will draw with it the magnet 37 attached to valve rod 33. This movement of the valve rod 33 takes place for an axial distance which is sufficient to allow, preferably, the whole of the baffle wall 6 to be exposed and to be freely accessible to gases passing through pumping duct 24. In a conventional fashion, the gases are successively trapped by the baffle wall 6 and the other walls such as 21 and 22 and then by the reservoir 8 which is at the temperature of liquid helium. The conical shape of the valve member 30 performs an important function during the pumping phase in that all the molecules which impinge upon it are very noticeably deflected, whatever their angle of incidence, towards baffle wall 6 and this of course makes for improved pumping efficiency. After a certain period, which may be relatively long, the cryopump may be considered as saturated by the condensed or adsorbed gases and needs to be regenerated. For this purpose, the valve member 30 is returned to the closed position 30', once again by the magnetic drawing action of the actuating ring 38, and the regeneration duct 40 is connected to a regenerating pump (not shown) by opening valve 41, at the same time as the pump is raised, by conventional means which are not shown, to the hot regenerating temperature. During this phase, the condensed and adsorbed gases generally sublime or, if they pass through a liquid phase, evaporate and are extracted from the housing 4 of the cryopump. Once regeneration has been completed, the cryopump is cooled again by introducing cryogenetic fluids into the liquid nitrogen reservoir 11 and the liquid helium reservoir 8 as described above, and once the cryopump has reached its cold temperature the valve member 30 may be returned to the open position to allow the pumping operation to be resumed.

It is possible for this cryopump to be used on its own in association with the enclosure to be evacuated and in this case it is of course clear that the leakage which necessarily takes place at the valve face 28 will result in a rise in pressure in the evacuated enclosure. Thus, the rise in pressure which does occur in the case in question must not be such as to have a prejudicial effect. If the rise in pressure were sufficiently great, it might be advantageous to bring into action the primary pumping means which are normally associated with the cryopump to generate the primary vacuum. If on the other hand any rise in pressure would be prejudicial to the satisfactory operation of the enclosure so evacuated, it would of course be necessary to use two cryopumps connected to the one enclosure to be evacuated which two cryopumps could operate simultaneously. In this case it would merely be necessary to space the regeneration phases apart in time, with one of the pumps operating when the other is being regenerated. When this is the case, one of the pumps, which may be termed the safety pump, may of course be smaller in size.

Figure 3:
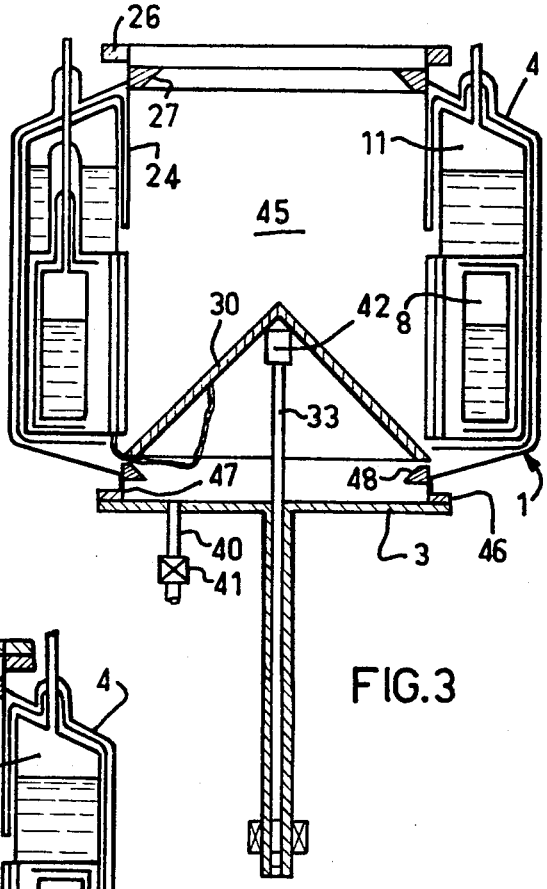
Figure 4:
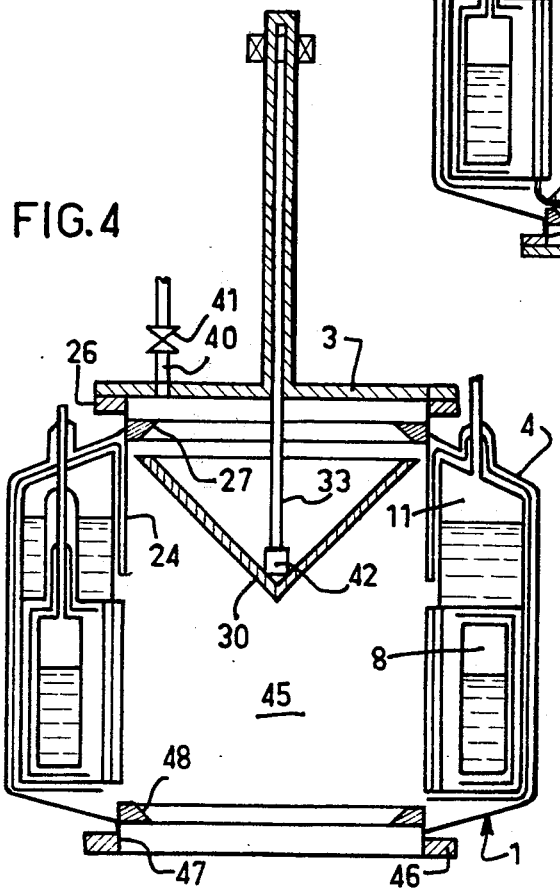

Referring to FIGS. 3 and 4, it can be seen that a cryopump 45, of the type which is described with reference to FIGS. 1 and 2, is now equipped with a lower end-wall 3 which is detachably secured to a second housing flange 46 identical to the flange 26 of the pumping duct 24. This flange 46 is in turn associated with a second pumping duct 47, of the same diameter as the first pumping duct 24, which is equipped with a second valve seating 48. In this way the housing end-wall 3, with its regenerating duct 40 and valve 41, may be mounted either at the bottom as shown in FIG. 3, in which case the cryopump is situated below the enclosure to be pumped out, or at the top as shown in FIG. 4, in which case the cryopump is situated above the enclosure to be pumped out. A device 42 enables the valve member 30 to be detached from its actuating rod 33, so that a changeover can be made from one pumping configuration to the other simply by turning the valve member 30 over manually within the cryopump, given that it cannot be totally withdrawn because of the presence of the two valve seatings 47 and 48.

Figure 5:
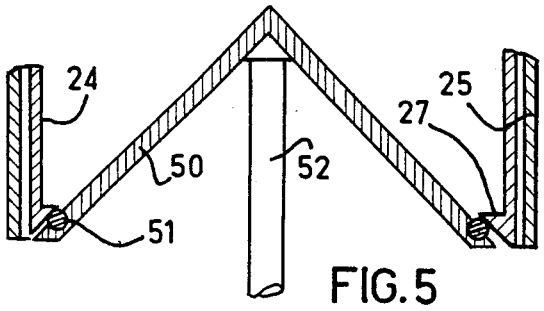
FIG. 5 is a modified embodiment of cryopump according to the invention.

In the modified embodiment shown in FIG. 5, a cryopump of the type illustrated in FIG. 1 is now fitted with a valve member 50 which is provided with a sealing gland 51, which may be made of "VITON" (registered trademark) for example, and the valve rod 15 is now associated with known actuating means which have a sealed passage through the end wall 3 of housing 4 and which are associated with known means for locking them in the closed position which are not described. This locking device enables the valve member 50 to be held in the closed position when the cryopump is under vacuum but the enclosure to be evacuated is still under pressure.

The invention is particularly applicable to pumps for generating ultra-high vacuums.

I claim:

1. A cryopump comprising a housing having a single pumping duct with a flange located at the outside end and adapted to connect said cryopump to an enclosure to be evacuated, a valve seating located inwardly in respect of said flange, annular cryogenic trapping means coaxial with said pumping duct, said cryogenic trapping means comprising helium refrigerated trapping means which are located in prolongation of said pumping duct, the radial extent of the central opening in said annular helium refrigerated trapping means being at least as great as that of said pumping duct, and a valve member which extends substantially radially and is mounted to slide axially in said opening in said trapping structure, the axial sliding travel of said valve being at least the axial length of said helium refrigerated trapping means.

2. A cryopump according to claim 1, wherein said housing wall which is opposite said housing wall through which the pumping duct passes is detachable and is secured to a second housing flange identical to that of said pumping duct, and wherein said housing has associated with it a second pumping duct situated in the area of said second housing flange, said second duct being in turn fitted with a second valve seating.

3. A cryopump according to claim 1, said cryogenic trapping means also comprising nitrogen refrigerated trapping means which are located in prolongation of said pumping duct between said helium refrigerated trapping means and said flange.

* * * * *